US008658084B2

(12) United States Patent
Morgenstern

(10) Patent No.: US 8,658,084 B2
(45) **Date of Patent: *Feb. 25, 2014**

(54) METHOD AND DEVICES FOR REGULATING THE FLOW RATE AND FOR SLOWING DOWN MELT STREAMS THROUGH MAGNETIC FIELDS IN THE TAPPING OF METALLURGICAL CONTAINERS SUCH AS BLAST FURNACES AND MELT FURNACES

(75) Inventor: Hans-Uwe Morgenstern, Freudenberg (DE)

(73) Assignee: TMT Tapping-Measuring-Technology GmbH (DE)

( * ) Notice: Subject to any disclaimer, the term of this patent is extended or adjusted under 35 U.S.C. 154(b) by 274 days.

This patent is subject to a terminal disclaimer.

(21) Appl. No.: 13/057,951

(22) PCT Filed: Aug. 6, 2009

(86) PCT No.: PCT/EP2009/060225

§ 371 (c)(1),
(2), (4) Date: Apr. 6, 2011

(87) PCT Pub. No.: WO2010/015684

PCT Pub. Date: Feb. 11, 2010

(65) Prior Publication Data

US 2011/0175265 A1 Jul. 21, 2011

(30) Foreign Application Priority Data

Aug. 7, 2008 (DE) ..... 10 2008 036 798

(51) Int. Cl.
*F15D 1/00* (2006.01)

(52) U.S. Cl.
USPC ..... 266/45; 266/237

(58) Field of Classification Search
USPC ..... 266/45, 237; 222/594, 597
See application file for complete search history.

(56) References Cited

U.S. PATENT DOCUMENTS 6,106,620 A 8/2000 Morrison
8,343,416 B2 * 1/2013 Morgenstern ..... 266/45

FOREIGN PATENT DOCUMENTS

CN 1154721 A 7/1997
JP 03198974 A 8/1991

(Continued)

OTHER PUBLICATIONS

PCT Translation of the International Preliminary Report on Patentability, Application No. PCT/EP2009/060225, Feb. 17, 2011.

(Continued)

*Primary Examiner* — Scott Kastler
(74) *Attorney, Agent, or Firm* — Quarles & Brady LLP

(57) ABSTRACT

The invention relates to a method for regulating the flow rate and for slowing down melt streams through magnetic fields in the tapping of metallurgical containers such as blast furnaces and melt furnaces. The method is characterized in that the melt stream is routed in a closed routing element using at least two magnetic fields disposed in series one after the other in the flow direction of the melt, said magnetic fields having a constant polarity opposite to one another, in such a way that the magnetic field lines transversally penetrate the melt flow across the entire cross section thereof and such that opposite voltages are induced in the melt stream by the magnetic fields, there being at least three eddy current fields produced thereby in the melt stream that are disposed axially one after the other, and that due to the interactions between the magnetic fields and the eddy currents forces are generated that can be used to reduce the flow rate of the melt stream.

13 Claims, 6 Drawing Sheets

(56) References Cited

FOREIGN PATENT DOCUMENTS

Figure 1:
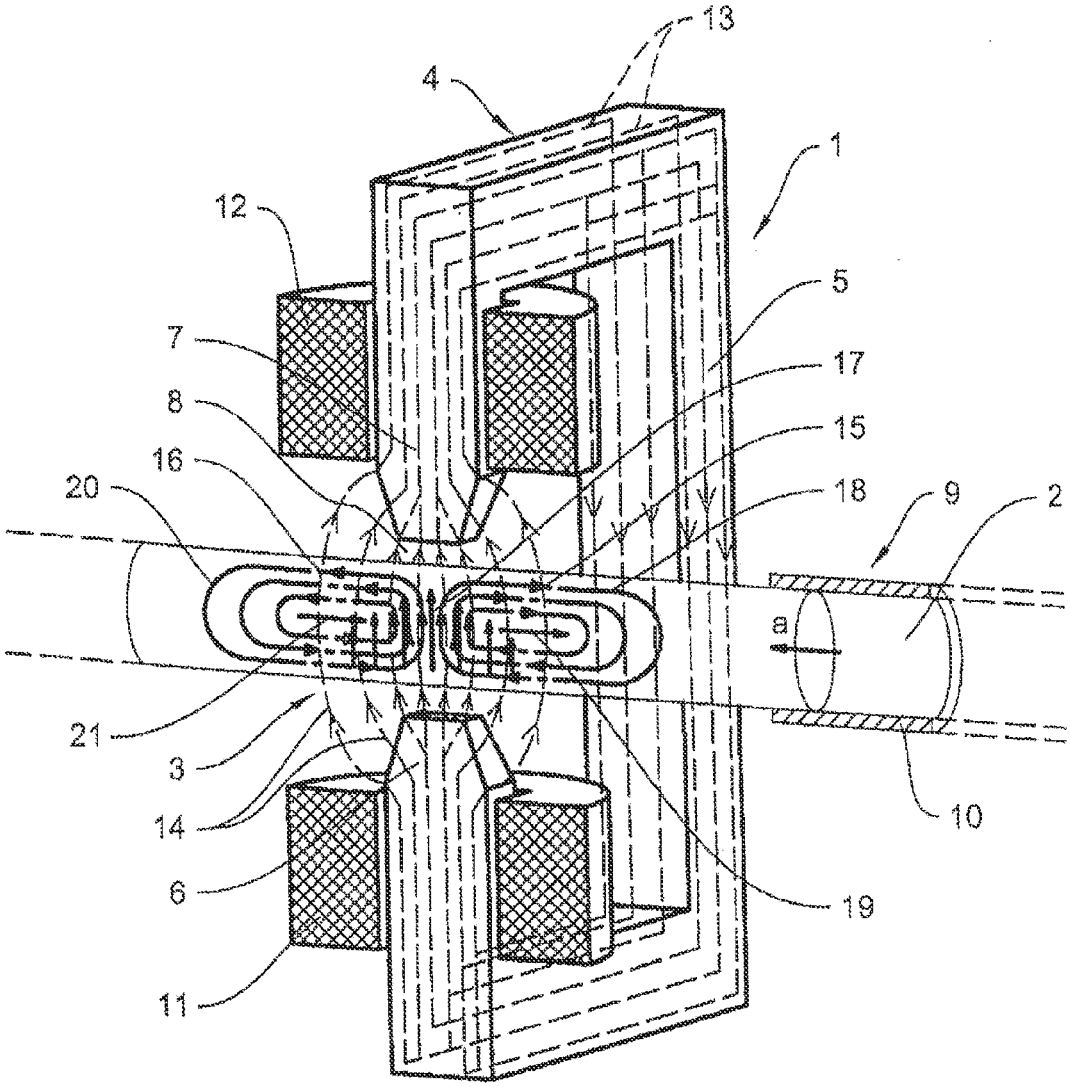

| | | | |
|---|---|---|---|
| JP | 10029044 | A | 2/1998 |
| JP | 2000176609 | A | 6/2000 |
| WO | 00/71761 | A | 11/2000 |

OTHER PUBLICATIONS

International Search Report as mailed on Jan. 26, 2010 for International Application No. PCT/EP2009/060225.

English Translation of Japan Patent Office Notice of Reasons for Rejections, JP 2011-521585, Apr. 2, 2013, 2 pages.

* cited by examiner

METHOD AND DEVICES FOR REGULATING THE FLOW RATE AND FOR SLOWING DOWN MELT STREAMS THROUGH MAGNETIC FIELDS IN THE TAPPING OF METALLURGICAL CONTAINERS SUCH AS BLAST FURNACES AND MELT FURNACES

CROSS-REFERENCE TO RELATED APPLICATIONS

The present application claims the benefit of German Patent Application No. DE 10 2008 036 798.2 filed Aug. 7, 2008, and is a national stage application of PCT International Application No. PCT/EP2009/060225 filed on Aug 6, 2009, both of which are incorporated herein by reference.

The invention relates to a method and devices for regulating the flow rate and for slowing down non-ferromagnetic melt streams through magnetic fields in the tapping of metallurgical containers such as blast furnaces and melt furnaces.

A species-related regulating device is suggested in parallel patent application 10 2008 036 799.0-24, which device is characterized by a core made from ferromagnetic material and having two poles that form a gap to accommodate a routing element for a melt stream, and induction coils arranged on the core for generating a magnetic field that acts on the melt stream in the routing element situated between the poles.

In this regulating device, a closed magnetic circuit is used to generate a magnetic field, via which a voltage is induced in the melt stream, which voltage in turn causes eddy currents in the melt stream that interact with the magnetic field to generate forces which reduce and increase the flow rate of the melt stream and can also slow it down.

The object underlying the invention is to develop a method and devices for regulating the flow rate and for slowing down non-ferromagnetic melt streams with which the magnetic field acting on the melt stream and the eddy currents created thereby may be amplified to increase the forces acting on the melt stream.

This object is solved according to the invention with the method having the features described herein.

The method according to the invention for regulating the flow rate and slowing down non-ferromagnetic melt streams when tapping metallurgical containers such as blast furnaces and melt furnaces is characterized in that the melt stream is routed in a closed routing element through at least two magnetic fields disposed in series one after the other in the flow direction of the melt, said magnetic fields having a constant polarity opposite to one another, in such a way that the magnetic field lines transversely penetrate the melt flow across the entire cross section thereof and such that opposite voltages are induced in the melt stream by the magnetic fields, the voltages producing at least three eddy current fields in the melt stream that are disposed axially one after the other, and that the interaction between the magnetic fields and the eddy currents generates forces that may be used to slow the flow rate of the melt stream depending on the strengths of the magnetic fields.

In a preferred embodiment of this method, the magnetic flux of a closed magnetic circuit induces a double, opposite voltage across two opposite magnetic fields between each of two poles in the melt stream such that a mutually amplifying effect is created on the current strength of the central, axial eddy current field.

As a result of this double exploitation of the magnetic flux in a closed magnetic circuit, the magnetic resistance in the iron core of the magnetic circuit and thus also the internal losses of the magnetic circuit are roughly halved.

In a variant of the method, the magnetic flux from two closed magnetic fields disposed one after the other induces voltages in the melt stream across two opposite magnetic fields between each of two poles such that a mutually amplifying effect is created on the current strength of the central eddy current field.

When the magnetic fields acting on the melt stream are disposed closely one behind the other in a gap between the two poles of a magnetic circuit, the attenuation gradient of the magnetic flux towards the lateral edge of the gap is as large as possible and the position of the gaps in close proximity to one another shortens the path length of the eddy current in the eddy current fields produced in the melt stream, and the electric resistance is lowered.

The basic inventive thought is based on the fact that by making double use of the magnetic flux of a closed magnetic circuit it is possible to induce a double, opposite voltage in the melt stream that amplifies the eddy current, wherein the magnetic resistance in the iron core, and thus also the internal losses, are approximately halved.

When multiple individually closed magnetic circuits making double use of the magnetic flux are arranged one after the other, the effect on the melt stream is increased disproportionately by a disproportionately greater number of steeper magnetic flux gradients by a disproportionate increase in the number of amplified eddy current fields, each of which has a double interaction with the magnetic fields, and by the double use of the inductive effect of the electric induction coils. This multiple use and the associated distribution of eddy currents in the individual eddy current fields in the melt stream have a multiplied, similar effect in amplifying the forces acting the melt stream.

Devices for regulating the flow rate and for slowing melt streams that function according to the method described above, and which are used particularly when tapping blast furnaces, will be explained in the following with reference to diagrammatic drawing figures, in which:

FIG. 1 is a perspective representation of a regulating device according to the one parallel patent application 10 200 036 799.0-24 having a magnetic field with constant polarity for regulating the flow rate and slowing down a melt stream.

Figure 2:
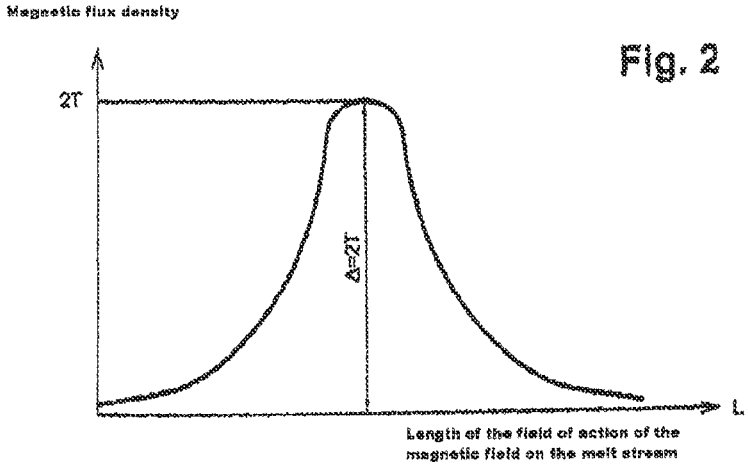
Figure 4:
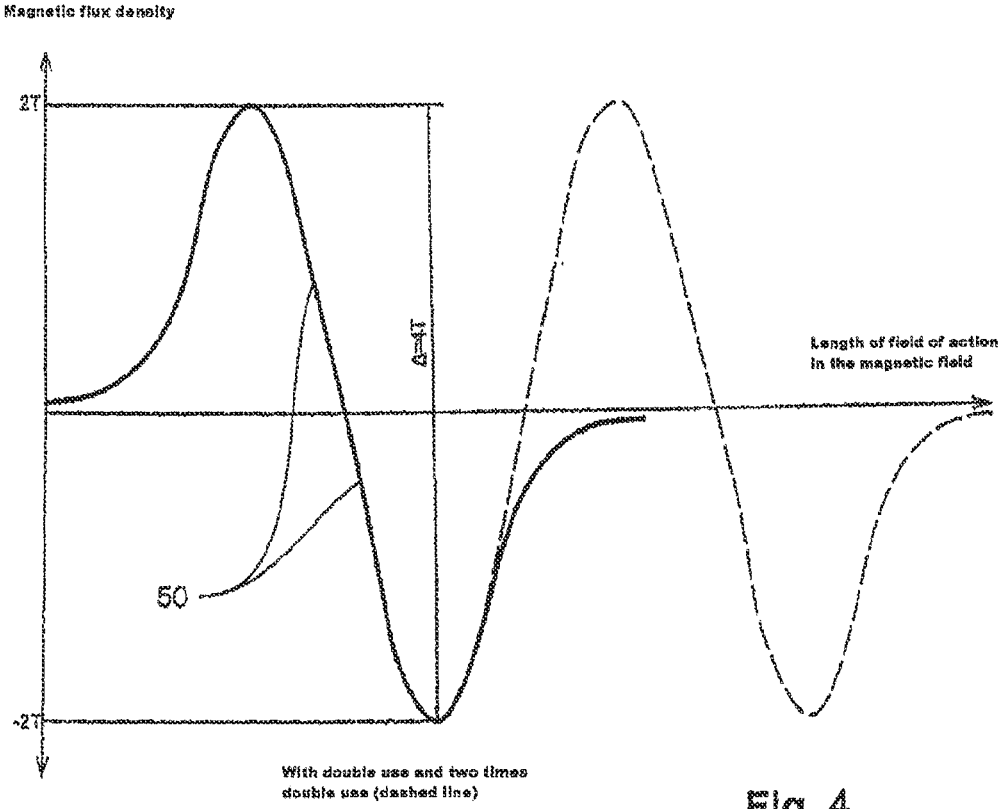
Figure 3:
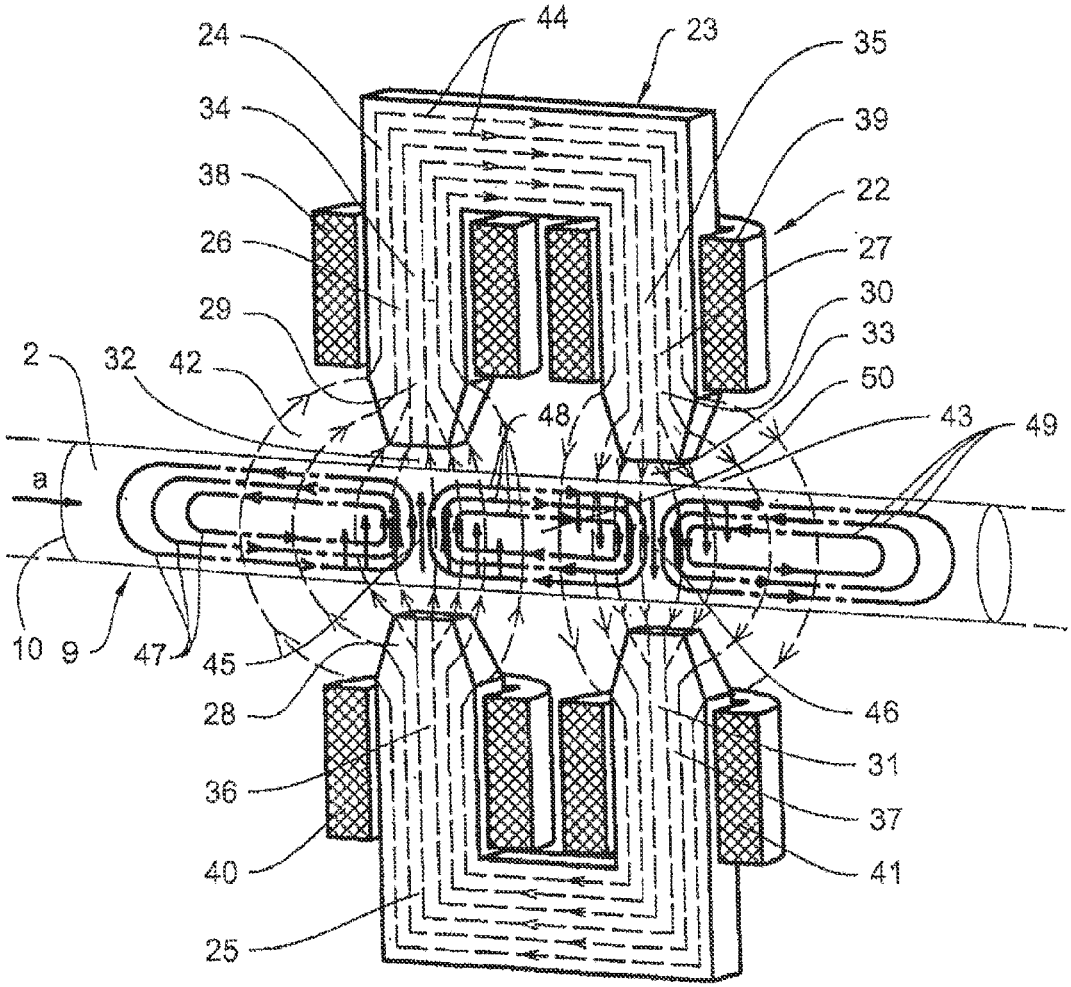
Figure 5:
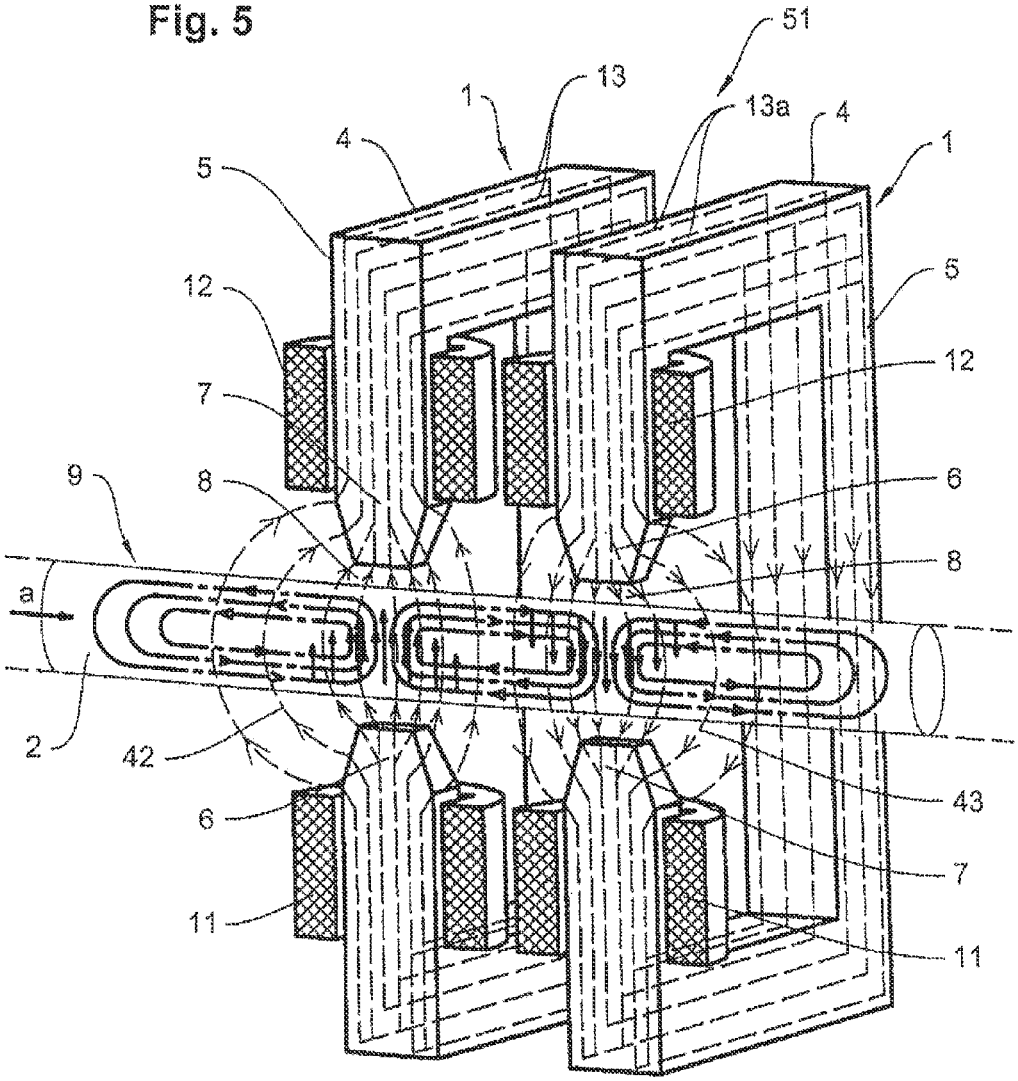
Figure 6:
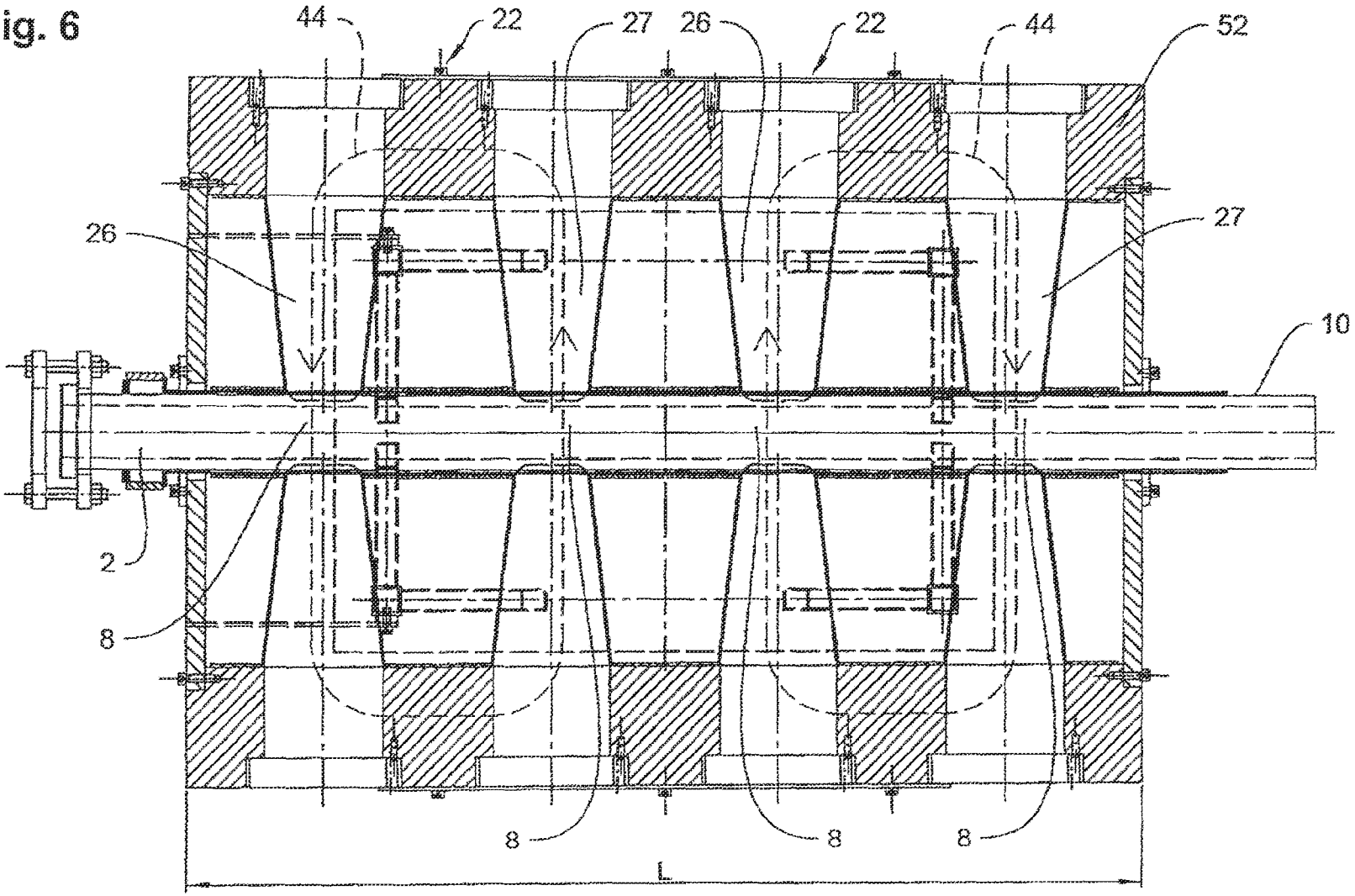
Figure 7:
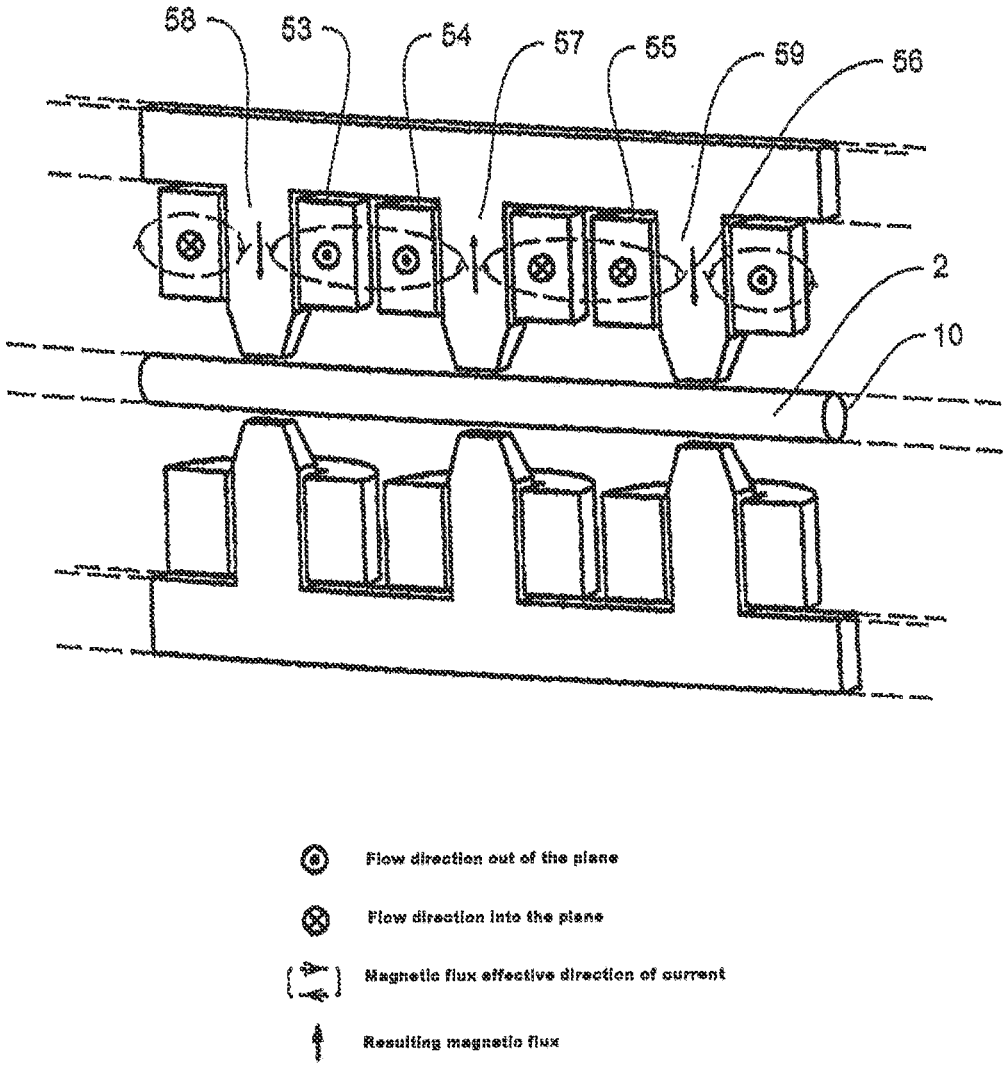

FIG. 2 is a diagram showing the magnetic flux strength curve of the magnetic field produced with the regulating device shown in FIG. 1 over the length of the field of action of the magnetic field on the melt stream, FIG. 3 is a perspective representation of a first embodiment of the regulating device according to the invention, FIG. 4 is a diagram showing the magnetic flux strength curve of the two magnetic fields produced with the regulating device shown in FIG. 3 and also showing the magnetic flux strength curve of the two magnetic fields of a further regulating device of identical construction and disposed downstream of the first regulating device, FIG. 5 is a perspective representation of a further embodiment of the regulating device, FIG. 6 shows the arrangement of a regulating device in front of the outflow opening of a tap hole channel in a blast furnace, and FIG. 7 is a schematic representation of the double use of the magnetic flux inducing effect of electric induction coils.

Regulating device 1 as shown in FIG. 1, which is preferably used when tapping blast furnaces to regulate the flow rate and to slow down a melt stream 2 through a magnetic field 3 having constant polarity, includes a core 4 of ferromagnetic material that is constructed in the form of a yoke 5 with two poles 6, 7 which form a gap 8 to accommodate a routing element 9 in the form of a pipe 10 for guiding melt stream 2 through. Two induction coils 11, are disposed on yoke 5 to produce a closed magnetic circuit 13 with the constant polarity magnetic field 3 between the two poles 6, 7, the magnetic field being indicated by field lines 14.

Melt stream 2 enters magnetic field 3 in area 15 and leaves it again in area 16. When melt stream 2 enters magnetic field 3, a voltage 17 is induced in the melt stream in a plane perpendicular to magnetic field lines 14, and as stated in Lenz's law this voltage produces axial eddy currents 18 in melt stream 2. The interaction between magnetic field 3 and eddy currents 18 generates Lorentz forces 19 in melt stream 2, which forces act in the opposite direction to the direction of flow a of melt stream 2 and thus exert a braking effect on melt stream 2, so that the flow rate of the melt stream is reduced.

When melt stream 2 leaves the exit area 16 of magnetic field 3, eddy currents 20 are produced in the stream, and these in turn also produce Lorentz forces 21 by their interaction with magnetic field 3, and these forces also act in the opposite direction to the direction of flow a of melt stream 2, so that they trigger a braking effect in addition to the braking effect of the Lorentz forces 19 in area 15 where melt stream 2 enters magnetic field 3.

In order to illustrate this effect more clearly, the induced. voltages 17 and the eddy currents 18, 20 in FIG. 1 are shown rotated through 90° from the horizontal plane to the vertical plane.

The diagram in FIG. 2 shows the magnetic flux strength curve of the magnetic field 3 produced using regulating device 1 according to FIG. 1 in Tesla over length L of the field. of action of magnetic field 3 on melt stream 2. The magnetic saturation in iron means that a magnetic flux strength above 2 Tesla can only be achieved by means that are no longer financially justifiable. The spread of magnetic field 3 in the gap 8 between poles 6 and 7, which is illustrated by curved magnetic field lines 14 means that the magnetic flux strength curve runs wide and shallow towards both borders of gap 8 between poles 6, 7. An electrical voltage 17 is induced in melt stream 2 within magnetic field 3, reflecting the strength and polarity thereof, which acting as the driving force for eddy currents 18, 20, so that the eddy currents can only close the electrical circuit outside magnetic field 3. The reduced gradient of attenuation of the magnetic flux strength results in wider eddy current fields 18, 20 with long current paths. Reflecting this comparatively long path length, relatively large electrical resistances arise, and this in. turn leads to correspondingly reduced eddy current strengths.

The forces produced by the interaction between the eddy currents and the magnetic field are dependent among other things on the strength of the eddy currents, which in turn are dependent among other things on the length of the current path. The shorter the current path, the lower the electrical resistance, and the eddy current that is produced with all other conditions the same is correspondingly larger. Since the current paths are usually unable to close until they are outside the magnetic field, a magnetic field that falls as steeply as possible towards zero at the edge would be ideal for these purposes. In reality, however, a magnetic field extends over a wide range, as is evident from FIG. 2.

Furthermore, the eddy current on the current path produced normally only interacts with a magnetic field once, and therefore only generates a force once.

Therefore, if two magnetic fields with opposite polarities are placed close to each other in such manner that the magnetic field lines cross the melt stream transversely, the following advantages are obtained:

1. The magnetic field has the steepest possible gradient towards the edge in the direction of the inverted, second magnetic field, and thus produces the shortest possible current path, as illustrated in FIG. 4.
2. Because the adjacent magnetic field has the opposite polarity, its effect on the same eddy current loop is in the same direction and amplifying/doubling. This phenomenon will be explained in detail in the following description of FIG. 4.

New regulating device 22 as represented in FIG. 3, which is used to regulate the flow rate of and slow down a melt stream 2 in the tap hole channel of a blast furnace, particularly when tapping blast furnaces, is equipped with a core 23 of ferromagnetic material consisting of two yokes 24, 25, which core has two pole pairs 26, 27, each having two poles 28, 29; 30, 31, and disposed in series one after the other. The two pole pairs 26, 27 form two gaps 32, 33 arranged one after the other to accommodate a routing element 9 through which the melt stream 2 passes, and which has the form of a pipe 10 or a channel. Four induction coils 38-41 are disposed on the four pole shoes 34-37 of the two yokes 24, 25 of core 23 to generate two magnetic fields 42, 43 in a closed magnetic circuit 44 between poles 28, 29; 30, 31 of the two pole pairs 26, 27, these magnetic fields being arranged in series one after the other in the direction of flow a of melt stream 2, wherein the polarities of the two magnetic fields 42, 43 are constant and opposite. The magnetic fields 42, 43 serve to induce opposite voltages 45, 46 in melt stream 2, by which the three eddy current fields 47-49 are produced axially one after the other in the melt stream 2 in such manner that a mutually amplifying effect is obtained on the current strength of central eddy current field 48 between the two outer eddy current fields 47, 49. The interaction between magnetic fields and eddy currents causes forces to be produced in the melt stream, which forces may be used to reduce the flow rate of the melt stream.

The regulating device may be expanded as needed with an even number of pole pairs over the length of the field of action of the magnetic fields on the melt stream to increase the braking force acting on a melt stream.

The diagram in FIG. 4 illustrates the magnetic flux density curve in Tesla, indicated by the solid line, of the two magnetic fields 42, 43 that are generated in a closed magnetic circuit 44 by the regulating device 22 over length L of the field of action of the magnetic fields on the melt stream, and indicated by the dashed line, the magnetic flux density of both magnetic fields of a second regulating device, of identical construction with first regulating device 22 and connected thereto.

The solid graph line in FIG. 4 illustrates that in the regulating device 22 of FIG. 3 the magnetic flux is used twice and with different polarities in a closed magnetic circuit 44. This has the effect of increasing the density of the magnetic flux, which in turn increases the eddy current strength correspondingly. The double use in a closed magnetic circuit takes place in opposite directions, which means that the magnetic flux is effective in both the positive and negative flow directions. Consequently, the magnetic flux density that can be used to produce eddy current is increased from about 2 Tesla to 4 Tesla in the same magnetic circuit. Moreover, the magnetic flux attenuation gradient in the region 50 shown in FIG. 4 is particularly sharp between the two magnetic fields 42, 43. In this way, the path lengths of the eddy currents and thus also the electrical resistances are smaller, resulting in a corresponding increase in current strengths.

The solid and dashed lines in FIG. 4 show the plot of the magnetic flux density over the length of the field of action of the magnetic fields on the melt stream by two regulating devices arranged one after the other as shown in FIG. 3, with two consecutive, closed magnetic circuits each making double use of the magnetic flux. FIG. 4 illustrates that a regulating device with a closed magnetic circuit yields a steep curve for the magnetic flux density between two flat slopes, and that when two regulating devices with two closed magnetic circuits making double use of the magnetic flux in each magnetic circuit are arranged one after the other, three steep curves are produced between two shallow curves for the magnetic flux density. The effect thus clearly increases disproportionately.

In regulating device 22 according to FIG. 3, gaps 32, 33 are located between poles 28, 29 and 30, 31, and the magnetic fields 42, 43 present in gaps 32, 33 are close together. Magnetic fields 42, 43 are bundled closely together in area 50, where they collide with each other despite the high magnetic flux density. From the correspondingly shortened current paths of the eddy currents and the doubled action of the eddy currents, it follows that the effect of the electromagnetic influence on the melt stream is more than doubled.

FIG. 5 shows another embodiment 51 of the regulating device, in which two regulating devices 1 as shown in FIG. 1 are connected one after the other.

Regulating device 51 is equipped with two cores 4, 4 arranged one after the other and made from a ferromagnetic material, and which have a yoke 5 with two poles 6, 7 that form a gap 8, and a routing element 9, particularly a tap hole channel of a blast furnace for a melt stream 2, passes through the two gaps 8, 8 arranged in series one after the other. Regulating device 51 is also equipped with two induction coils 11, 12 on each of the pole shoes of both yokes 5, 5 to generate two magnetic fields 42, 43, one behind the other and having opposite polarities, in two separate, closed and opposite magnetic circuits 13, 13 *a*, wherein magnetic fields 42, 43 generated axial eddy currents in melt stream 2 to produce a braking force that acts on melt stream 2.

Compared with a regulating device as shown in FIG. 3, which works with double use of the magnetic flux in one closed magnetic circuit, regulating device 51 of FIG. 5 makes single use of the magnetic flux in two closed magnetic circuits arranged one after the other and reveals a lower degree of effectiveness, but with this regulating device substantial amplification of the eddy currents in the melt stream is achieved compared with the regulating device of FIG. 1 with one closed magnetic circuit and single use of the magnetic flux.

Whereas a regulating device designed for maximum multiple uses of the magnetic flux of a magnetic circuit is only capable of working with an even number of pole pairs, a regulating device that makes single use of the magnetic flux in multiple magnetic circuits is able to work with both an even and an odd number of pole pairs. Depending on the circumstances, a regulating device may also he more readily adaptable to limited space.

The various regulating devices 22, 51 may be set up as supplementary devices in front of the outflow opening of a blast furnace tap hole channel or in front of the outflow opening of a melt furnace drainage channel around the tap hole channel or the drainage channel respectively.

FIG. 6 shows the arrangement of two regulating devices 22 of FIG. 3 arranged, one behind, the other in front of the outflow opening of a blast furnace tap hole channel. Two closed magnetic circuits 44 with four gaps 8 for double use of the magnetic flux in each magnetic circuit are disposed inside a housing 52. The melt stream 2 flows out of the blast furnace tap hole channel and through pipe 10, which passes through the four gaps 8 between four pole pairs 26, 27; 26, 27, wherein the magnetic fields of both magnetic circuits 44 act on melt stream 2 over length L.

FIG. 7 shows three induction coils 53-55, each having an iron core, from a multiple arrangement of induction coils with iron cores for creating closed magnetic circuits with double use of the magnetic flux to produce eddy currents in a melt stream 2, which melt stream flows through a pipe 10. Coils 53-55 must be driven with alternately opposite polarities. The current directions of the right and left coil halves in each case and the direction of the magnetic flux 56 resulting therefrom are indicated in the figure. With reference to the top middle core 57 and its magnetic flux, it is not only its associated coil 54 but also in this plane the right coil half of coil 53 of left core 58 and the left coil half of coil 55 of core 59 that are effective. Thus in this example the left coil half of coil 55 of the right core 59 have a magnetic flux driving effect both on right core 59 and on middle core 57. The same principle applies for all coil halves in a multiple arrangement, with the result that in the plane of the display, with the exception of the coil halves on the extreme left and right, double use is made of all coil halves and the currents flowing in them. In this way, a further disproportionate increase in effect is achieved.

The invention claimed is:

1. A method for regulating the flow rate and for slowing down a non-ferromagnetic melt streams with magnetic fields when tapping metallurgical containers such as blast furnaces and melt furnaces, said method comprising:

routing a melt stream in a closed routing element through at least two magnetic fields disposed in series one after the other in a flow direction of the melt stream, said magnetic fields having a constant polarity opposite to one another, in such a way that the magnetic field lines transversely penetrate the melt stream across the entire cross section thereof and such that opposite voltages are induced in the melt stream by the magnetic fields, the voltages producing at least three eddy current fields in the melt stream that are disposed axially one after the other, and that the interaction between the magnetic fields and the eddy currents generates forces via which the flow rate of the melt stream can be slowed depending on the strengths of the magnetic fields.

2. The method as recited in claim 1, including inducing a double, opposite voltage across two opposite magnetic fields between each of two poles in the melt stream using a magnetic flux of a closed magnetic circuit, such that a mutually amplifying effect is created on the current strength of a central eddy current field.

3. The method as recited in claim 2, in which the magnetic flux in the closed magnetic circuit causes the magnetic resistance in an iron core of the magnetic circuit and thus also the internal losses of the magnetic circuit to be approximately halved.

4. The method as recited in claim 1, in which as a result of the magnetic flux from the at least two magnetic fields disposed one after the other, voltages are induced in the melt stream across two opposite magnetic fields between each of two poles such that a mutually amplifying effect is created on the current strength of the central, axial eddy current field.

5. The method as recited claim 1, in which the magnetic fields acting on the melt stream are disposed closely one behind the other in a gap between the two poles of a magnetic circuit in such manner that the attenuation gradient of the magnetic flux towards a lateral edge of the gap is as large as possible and the position of the gaps in close proximity to one another shortens the path length of the eddy currents in the eddy current fields produced in the melt stream, and the electric resistance is lowered.

6. A regulating device for regulating the flow rate and for slowing down non-ferromagnetic melt streams when tapping metallurgical containers such as blast furnaces and melt furnaces, said device comprising:

at least one core of ferromagnetic material formed by two yokes, and which has two pole pairs arranged one behind the other, each of which has two poles, which form two gaps arranged one behind the other to accommodate a routing element for a melt stream; and four induction coils disposed on pole shoes of the two yokes of the core generating two magnetic fields of opposite polarity in series one behind the other in a closed magnetic circuit, which act on the melt stream in the routing element, which passes through the gaps between the poles of the two pole pairs in such a way that the magnetic fields transversely penetrate the melt stream across the entire cross section thereof and such that opposite voltages are induced in the melt stream by the magnetic fields, the voltages producing at least three eddy current fields in the melt stream that are disposed axially one after the other, and that the interaction between the magnetic fields and the eddy currents generates forces via which the flow rate of the melt stream can be slowed depending on the strengths of the magnetic fields.

7. A regulating device for regulating the flow rate and for slowing down non-ferromagnetic melt streams when tapping metallurgical containers such as blast furnaces and melt furnaces, said device comprising:

at least two cores of ferromagnetic material arranged in series one behind the other, each of which has a yoke with two poles which form a gap and two pole shoes, wherein a routing element for a melt stream passes through both gaps which are arranged in series one behind the other; and two induction coils disposed on each of the pole shoes of the two yokes to generating two magnetic fields of opposite polarity in series one behind the other in two separate, closed, opposite magnetic circuits, wherein the magnetic fields create axial eddy currents in the melt stream which produces a braking force that acts on the melt stream in such a way that the magnetic fields transversely penetrate the melt stream across the entire cross section thereof and such that opposite voltages are induced in the melt stream by the magnetic fields, the voltages producing at least three eddy current fields in the melt stream that are disposed axially one after the other, and that the interaction between the magnetic fields and the eddy currents generates forces via which the flow rate of the melt stream can be slowed depending on the strengths of the magnetic fields.

8. The regulating device as recited in claim 6, in which said said regulating device is expandable with even numbers of pole pairs.

9. The regulating device as recited in claim 7, in which said said regulating device is expandable with even and odd numbers of pole pairs.

10. The regulating device as recited in claim 6, located in front of an outflow opening of a furnace melt channel.

11. The regulating device as recited in claim 6, located around a furnace melt channel.

12. The regulating device as recited in claim 7, located in front of an outflow opening of a furnace melt channel.

13. The regulating device as recited in claim 7, located around a furnace melt channel.

* * * * *

UNITED STATES PATENT AND TRADEMARK OFFICE

CERTIFICATE OF CORRECTION

PATENT NO. : 8,658,084 B2
APPLICATION NO. : 13/057951
DATED : February 25, 2014
INVENTOR(S) : Morgenstern It is certified that error appears in the above-identified patent and that said Letters Patent is hereby corrected as shown below:

In the Specification

Column 2, line 41, "200" should be changed to --2008--

In the Claims

Claim 7, Column 8, line 5, "yokes to generating" should be changed to --yokes generating--

Signed and Sealed this
Tenth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,658,084 B2
APPLICATION NO. : 13/057951
DATED : February 25, 2014
INVENTOR(S) : Hans-Uwe Morgenstern It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 334 days.

Signed and Sealed this
Twenty-ninth Day of September, 2015

Michelle K. Lee

Michelle K. Lee
*Director of the United States Patent and Trademark Office*